US010058756B1

(12) United States Patent
Basilone

(10) Patent No.: US 10,058,756 B1
(45) Date of Patent: Aug. 28, 2018

(54) TRAINING ASSEMBLY AND METHOD FOR TEACHING BATTING TECHNIQUE IN BASEBALL AND SOFTBALL

(71) Applicant: James G. Basilone, Springdale, PA (US)

(72) Inventor: James G. Basilone, Springdale, PA (US)

( * ) Notice: Subject to any disclaimer, the term of this patent is extended or adjusted under 35 U.S.C. 154(b) by 0 days.

(21) Appl. No.: 15/727,827

(22) Filed: Oct. 9, 2017

Related U.S. Application Data

(63) Continuation-in-part of application No. 15/346,942, filed on Nov. 9, 2016.

(51) Int. Cl.
*A63B 69/00* (2006.01)
*A63B 102/18* (2015.01)

(52) U.S. Cl.
CPC .. *A63B 69/0002* (2013.01); *A63B 2069/0008* (2013.01); *A63B 2102/182* (2015.10); *A63B 2225/093* (2013.01)

(58) Field of Classification Search
USPC ..... 473/409, 415, 422, 451, 453
See application file for complete search history.

(56) References Cited

U.S. PATENT DOCUMENTS 5,478,070 A * 12/1995 Morrison ..... A63B 69/0075 473/419
6,296,581 B1 * 10/2001 Sever ..... A63B 47/002 473/415
8,118,692 B2 2/2012 Day et al.
8,241,155 B1 8/2012 Rauso

* cited by examiner

*Primary Examiner* — Nini Legesse
(74) *Attorney, Agent, or Firm* — Karen Tang-Wai Sutton

(57) ABSTRACT

A trainer assembly for teaching effective baseball and softball batting technique includes a sleeve having an interior bat chamber adapted to house a barrel of a baseball bat and having a single open end terminating in a guide, and a retractable arm affixed to a closed end of the sleeve that is length adjustable and rotatable within an attached elbow, allowing a range of angle adjustment for positioning the sleeve. The elbow is 360 degrees rotatably affixed to a support at one end and at an opposite end holds the retractable arm at a fixed 45 degree angle below a horizontal plane measured from a top of the elbow. The elbow's horizontal rotation can be optionally locked. In an improved embodiment, the support is height adjustable via telescoping shaft portions. A method for using the trainer assembly is included.

14 Claims, 8 Drawing Sheets

200

TRAINING ASSEMBLY AND METHOD FOR TEACHING BATTING TECHNIQUE IN BASEBALL AND SOFTBALL

CROSS REFERENCE TO RELATED APPLICATIONS

Reference is made to and priority claimed from U.S. application Ser. No. 15/346,942 filed 9 Nov. 2016.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION BY REFERENCE OF MATERIAL SUBMITTED ON A COMPACT DISC OR AS A TEXT FILE VIA THE EFS WEB SYSTEM

Not applicable.

STATEMENT REGARDING PRIOR DISCLOSURES BY THE INVENTOR OR A JOINT INVENTOR

Not applicable.

BACKGROUND OF THE INVENTION

(1) Field of the Invention

The present invention pertains to the field of the game of baseball and softball. More particularly, the present invention pertains to training devices and methods to teach good batting technique to baseball and softball batters, and to correct or troubleshoot poor batting technique in seasoned players.

(2) Background Art

As America's greatest pastime, the sport of baseball has captivated the American spirit for nearly 180 years. Since the humble beginnings of the sport through the vision of Abner Doubleday in 1839 to the modern era of the game, baseball, and its popular derivative sport, softball, continues to bring families and sports fans together in a way that no other sport has in our culture. The passion and commitment to master the art and science involved to play well is evidenced across small-town America to the biggest stadiums in the biggest cities, stretching from tee-ball, to little league, to high school and travel teams, to NCAA and college club sports programs, to the major leagues. Baseball has developed into a world sport with dozens of nations competing in the annual Little League World Series and producing some of the most gifted players from around the globe to play professionally in the United States. Regardless of what town, state, or time zone you are from, baseball is a way of life. Many parents, having grown up playing the sport and rooting for their favorite players and teams, continue to pass down their love of the greatest American game.

Baseball is a difficult sport to learn, and becoming good at baseball requires discipline and dedication to learning and honing skills. Batting in particular challenges players at every skill level, and is believed to be one of the most difficult athletic maneuvers in the world of sports. The speed and movement of the ball working in forces against the speed and alignment of the batter's swing produces quite arguably one of the most incredible feats for any player at any level. For a player to successfully make contact with the ball in a way that they are able to safely make it to base just once in three attempts, on average, is considered to be a standard of excellence. In baseball, the advantage is almost always to the pitcher and his ability to beat the batter mentally, as well as physically through speed and movement.

Since each batter is physically different in terms of height, limb length, and preferred stance or position with regards to home plate, plus the bat is such that the batter has complete free range of motion when swinging, it is difficult to train batters in a systematic way to teach consistent range of motion and thus reliable and repeatable batting performance. Currently, batters of all skill levels work with human coaches who watch the batters bat and then provide verbal feedback such as "don't drop your back shoulder when you swing", or "turn your elbows down" and while the comments are helpful, they cannot physically guide the bat into a correct motion. The batter has to mentally process the comments and try to make corrections on his or her own. This process is time consuming and frustrating for both batter and coach, particularly when batting performance suddenly lags and the mechanical problem is neither easily diagnosed nor corrected. Good communication between batter and coach is key, but the batter still has to self-learn how to bat and coaches are not always available at all hours when the batter is practicing batting skills and perhaps unwittingly practicing bad batting behaviors when not under the watchful eye of a coach.

What is needed is a training assembly that physically guides the batter's bat into a correct motion to physically train the batter to learn effective, consistent technique, as well as a method of using the training assembly.

BRIEF SUMMARY OF THE INVENTION

In a first aspect of the invention, a trainer for use with a baseball bat is comprised of a telescopic receiver having a sleeve with an internal chamber accessed through an open end terminating in a partial cutaway guide, the internal chamber sized and shaped to receive a barrel of the baseball bat. A horizontally rotatable elbow having a receiver end and a support end is affixed to the telescopic receiver at the receiver end.

In a second aspect of the invention, the trainer has an interior chamber diameter of no more than three inches.

In a third aspect of the invention, the telescopic receiver is further comprised of a retractable arm having a first end slideably and rotatably coupled to the receiver end of the rotatable elbow, and a second end fixedly coupled to the closed end of the sleeve, and wherein the retractable arm slides in and out of the elbow and rotates within the elbow.

In a fourth aspect of the invention, the partial cutaway guide of the trainer is coupled to the sleeve and its position rotatably adjustable.

In yet a fifth aspect of the invention, an arm lock is provided coupled to the receiver end of the rotatable elbow, and an elbow lock is coupled to the upper shaft of the vertical support, both locks locked and unlocked by a twisting motion.

In still a sixth aspect of the invention a support affixed to the rotatable elbow at the support end is provided and further comprised of a shaft in telescoping relationship with a lower shaft.

In yet a seventh aspect of the invention, a method of teaching a batter to swing a bat using the trainer described aforesaid, comprising the steps of positioning a lowermost edge of the guide approximately at a height of the batter and rotating the guide so that when a baseball bat is inserted into the bat chamber of the sleeve, the baseball bat is between the batter and the guide, positioning the trainer behind a shoulder of a batter's upper hand on the handle as the batter assumes a batter's stance, adjusting the elbow so as to allow the bat chamber to accommodate the barrel location when the batter is in batter's stance holding the baseball bat, inserting the barrel into the bat chamber until the tape is at or below the lowermost edge of the guide, and pulling the barrel out of the bat chamber and guide to commence bat swing and follow through swing using a trajectory guided by the trainer.

BRIEF DESCRIPTION OF THE DRAWINGS

The features and advantages of the invention will become apparent from a consideration of the subsequent detailed description presented in connection with accompanying drawings, in which.

DRAWINGS LIST OF REFERENCE NUMERALS

Figure 1:
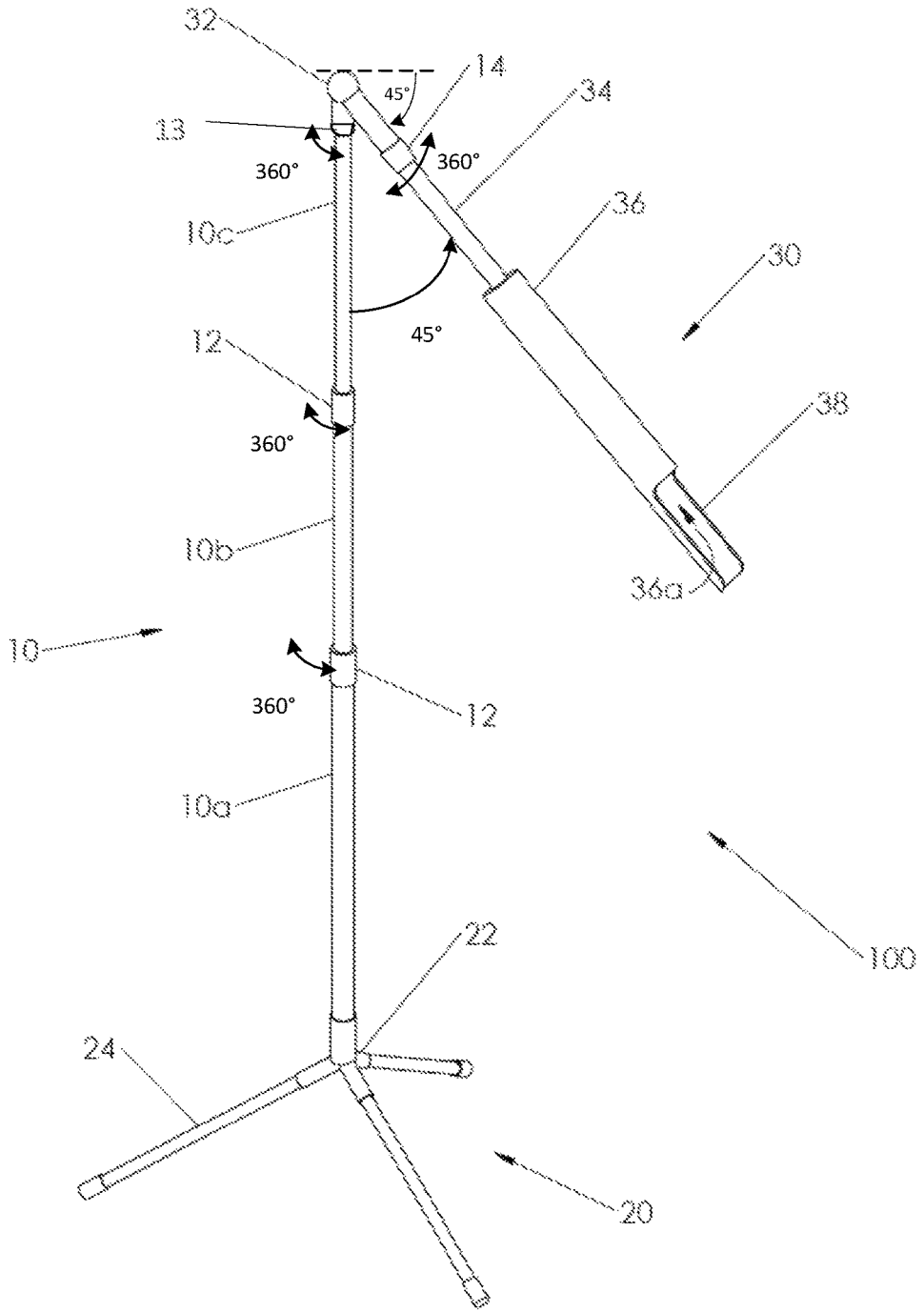
FIG. 1 is a perspective view of a batting training.
Figure 2:
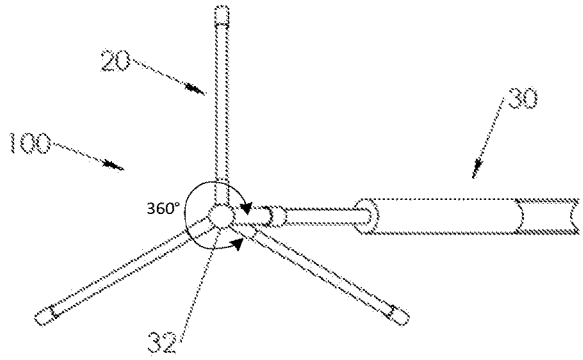
FIG. 2 is a top view of the trainer of FIG. 1
Figure 3:
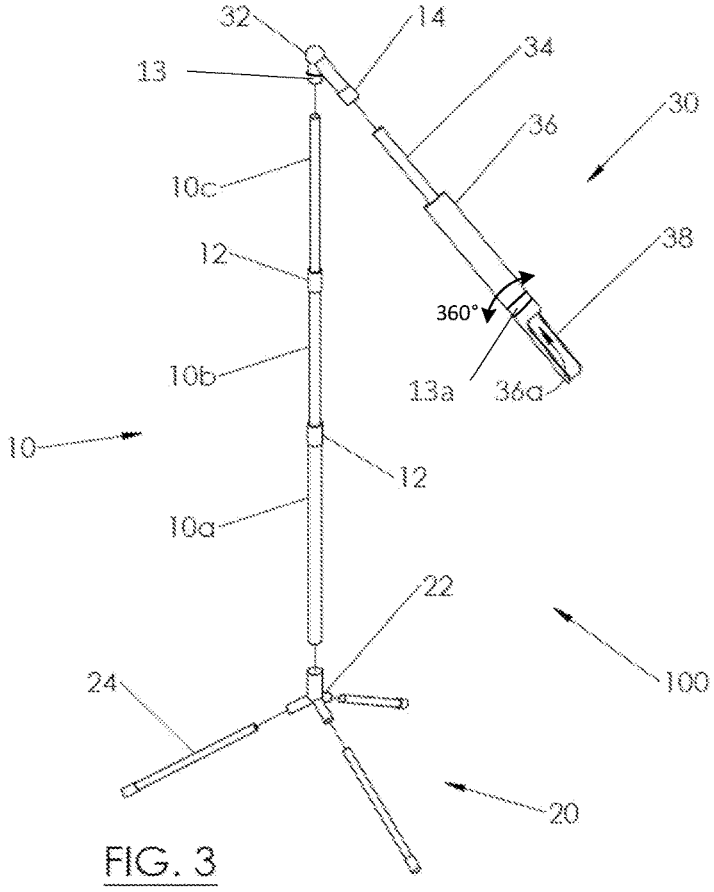
FIG. 3 is an exploded view of the trainer of FIG. 1.

The following is a list of reference labels used in the drawings to label components of different embodiments of the invention, and the names of the indicated components.

10 support or telescopic shaft
10*a* lower shaft
10*b* mid shaft
10*c* upper shaft
12 lock
13 elbow lock
13*a* guide lock
14 arm lock
20 stand
22 leg
24 leg set
30 bat receiver
32 elbow
34 retractable arm
36 sleeve
36*a* bat chamber
36*b* height of guide
38 guide
40 bat
42 barrel
44 handle
46 tape or handle mark
50 starting batting stance using a trainer
60 typical batting stance (prior art)
62 batter
64 shoulder
66 upper hand
68 forearm
100 batting trainer
200 method of using a batting trainer
202 position guide
204 position trainer
206 adjust elbow and retractable arm length
208 insert barrel of bat
210 slide barrel out of sleeve when swinging
300 method of swinging a baseball bat during batting (PRIOR ART)

DETAILED DESCRIPTION

A batting trainer apparatus or trainer 100 and a method 200 of using the trainer 100 according to the invention is shown in FIGS. 1-4*k* and FIG. 6. FIGS. 5*a-g* show a prior art method 300 of a common baseball bat swing. The term "baseball" is meant to include the related game of softball, and thus any reference to baseball is meant to include the both baseball and softball.

The trainer 100 is comprised of a support or telescoping shaft 10, typically a cylindrical tube with a hollow core and having a lower shaft 10*a*, mid shaft 10*b*, and an upper shaft 10*c*, the mid shaft 10*b* and upper shaft 10*c* each telescopically adjustable, so as to store inside the lower shaft 10*a*, or raised to a desired position and held in place by a lock 12, typically a twisting lock that can be locked or unlocked with a simple clockwise or counterclockwise twisting motion. Other suitable locks include spring pins coupling with position holes bored into the telescoping shaft 10 at desired intervals as well as other locking mechanisms easily locked and unlocked without tools. The telescoping shaft 10 at its lowermost end couples to a stand 20, comprising a leg set 22 coupling directly to the lowermost end of the telescoping shaft 10 and to a plurality of legs 22. In the Figures, the stand 20 is shown as a tripod having three legs 24, with a lowermost end of each leg contacting the ground, however the inventor notes that more or fewer legs, shorter legs, and even legs splayed in a horizontal plane where all or a portion of a length of the leg, such as in the case where the leg is bent or curved and is in direct contact with a ground surface is also suitable, as is a single vertical leg terminating in a flattened base, such as a coil, of sufficient size and stability to support the trainer 100 and not interfere with a batter's stance during batting. The inventor believes the current support 10 shown in the Figures results in a convenient, portable, and stable trainer that is lightweight and easily transported from batting cage to batter's box, and useable indoors and outdoors.

An adjustable elbow 32 having two ends is removably coupled to an uppermost end of the telescoping shaft 10, the upper shaft 10*c*, at a first end of the elbow, and to a bat receiver 30 at an opposed end of the elbow. An arm lock 13 found at the first end locks the elbow 32 to the uppermost end of the telescoping shaft, and is locked by twisting the lock to secure the elbow to the shaft and unlocked by untwisting the lock. The bat receiver 30 itself has a telescoping retractable arm 34 coupled to the elbow 32, with an arm lock 14 positioned at the opposed end of the elbow so as to maintain a desired length of the retractable arm 34. The elbow 32 is adjustable, and can freely rotate up to 360 degrees in a horizontal plane about the uppermost end of the telescoping shaft 10 (the uppermost end of the upper shaft 10*c*), as well as be locked into position by the elbow lock 13 so as to prevent horizontal rotation about the uppermost end of the telescoping shaft. The elbow 32 and retractable arm 34 have a typical adjustable length range between 10-25 inches long.

The inventor notes another useful embodiment of the horizontally rotatable elbow is formed by eliminating the elbow lock 13, and simply have the elbow 32 fixedly attached to the upper shaft 10*c*, or be formed as an extension of the upper shaft 10*c*, with the lowermost end of the upper shaft 10*c* rotatably coupled to the mid shaft 10*b*, so as to allow the upper shaft 10*c* and the attached elbow 32 and bat receiver 30 to rotate horizontally. The upper shaft 10*c* is then locked to the mid shaft 10*b* by the lock 12 to prevent rotation, as desired.

It is also possible to configure the elbow 32 as a ball joint that sits into the uppermost end of the upper shaft 10*c* and rotates freely horizontally, and eliminate the elbow lock 13 entirely.

The retractable arm 34 terminates in a sleeve 36 disposed as a cylindrical tube having a bat chamber 36*a* comprised of an opening or hollow space sized and shaped to receive a tip and a barrel 42 of a college or professional bat 40 having a diameter of 2.625 inches. It is noted that the elbow 32 holds the retractable arm 34 and thus also the sleeve 36 in a fixed 45 degree angle as measured below a horizontal plane. The elbow is thus has no vertical adjustment as the inventor believes that the fixed 45 degree angle is ideal for proper bat positioning, although concedes that a small range of values, such as 40-50 degrees from the horizontal plane, can be used. A typical embodiment of the trainer 100 according to the invention has a bat chamber 36*a* no larger than 3 inches in diameter, and about 16 inches in length. This size allows a range of bat sizes to be used with the trainer.

A guide 38, formed as a partial sleeve or partial cutaway of a wall of a lowermost portion of the sleeve 36 is about 6 inches in length, such that the sleeve and guide together are about 22 inches long. The inventor notes that this length is ideal as the sleeve and guide together hold almost the entire baseball bat length. The inventor notes that a 5 inch or a 7 inch guide may also work, although the inventor has noted that the shorter the guide is relative to 6 inches, the more difficult it becomes to remove the bat and have proper swing follow through, and the longer the guide is, again measured against the 6 inch guide length, causes the bat to be removed too quickly and thus encourage improper swing follow through. In the Figures, the guide 38 is shown both as a separate piece rotatably affixed to the open end of the sleeve (FIG. 3) as well as formed as a single unit with the sleeve (FIG. 1)

A tape or handle mark 46 of the bat, which marks the separation point of the barrel 42 from a handle 44 of the bat, is positioned no more than level with a lowermost end of the guide 38. The inventor notes that the tape 46, is a standard part of a typical baseball bat, and while traditionally is an actual piece of tape, the term tape here refers to any handle mark that shows the line of separation between the handle and the barrel, and thus can also be a stripe of paint, a colored stain line from the rest of the barrel or the handle, grip tape, or some other type of visual mark that clearly and unambiguously shows where the handle stops and the barrel begins. The location of the tape 46 is a standardized visual marker on every bat, although this mark may be missing on bats where additional tape is used as a handle grip. In these cases, the uppermost tape of the grip is where the handle ends and the barrel begins. For purposes of the method 200 described herein, the tape 46 is a convenient visual aid for a batter when he or she is using the trainer, allowing for repeatable and consistent bat positioning in the sleeve 36.

Turning now to FIGS. 4*a-k* and 6, the method 200 of swinging a bat using the trainer is depicted in a series of illustrations. To use the trainer for learning how to bat correctly, or to retrain the batter who has faulty technique, the batter 62 holding a bat 40 positions 202 the lowermost edge of the guide 38 at the batter's height 36*b*, as shown in FIGS. 4*a-d*, by adjusting the telescoping mid and upper shafts and their respective locks 12, as well as telescoping the retractable arm 34 of the bat receiver 30 and then locking the retractable arm length with the arm lock 14, and the elbow to the shaft by the elbow lock 13. The elbow and bat receiver 30, once locked, typically do not move once the batter commences batting practice with the trainer 100. In some methods of training, the locks are left open, so as to allow the elbow and thus the attached bat receiver to rotate horizontally about the upper shaft 10*c* when the batter is batting, to provide the batter information about his or her current bat swing and its deficiencies. When desired, the moving parts are locked to prevent movement and to train the batter proper technique. The inventor notes that in the Figures, the arm lock 14 is locked and unlocked by a simple twisting motion, however the retractable arm and other parts of the trainer 100 can be locked a number of different ways, such as with a series of holes (not shown) formed in the retractable arm with a corresponding hole formed into the elbow where it joins to the retractable arm and a desired length locked in place with a simple pin pushed into both the elbow and the retractable arm. In embodiments where the elbow is fixed to the upper shaft 10*c*, such as in the case where the upper shaft 10*c* and the elbow are a single unit, the upper shaft 10*c* itself rotates inside the mid shaft 10*b* at a point where both shafts are in telescoping relationship, or in some embodiments where the support 10 is only comprised of two parts, the upper shaft rotates inside the lower shaft 10*a*. In either embodiment, the upper shaft and thus the bat receiver 30 are prevented from rotating about the mid or lower shaft, as the case may be, by the lock 12.

Next, the sleeve 36 is positioned behind the shoulder of the batter when the batter 40 stands in a batting stance 50, so that the batter, when facing forward towards a pitcher's mound, is standing sideways with respect to a forward motion of a baseball thrown at the batter and with the bat over a shoulder 64 attached to an arm terminating in a batter's upper hand 66 resting on the handle 44 of the bat 204. In the Figures, a right handed batter is shown: if the upper hand 66 on the handle of the bat is a right hand, the batter is right handed, and the shoulder of interest is the right shoulder. The lowermost end of the guide 38 is positioned 204 behind the shoulder 64, and the elbow 32 of the trainer is adjusted 206 horizontally if necessary to allow the barrel 42 to easily insert into the sleeve 36. At this point, the elbow is either locked in place so that it cannot move horizontally at all, or alternatively, if desired, it is left unlocked so it can rotate freely in the horizontal plane and about the upper shaft 10*c*. The barrel 42 of the bat is inserted into the sleeve 208 by the batter until the tape 46 on the bat is at or below the lowermost edge of the guide. In FIGS. 4*a-d*, the sleeve 36 holds the bat 40 at about a 45 degree angle from the vertical, tilting the barrel behind the batter. The sleeve 36 keeps the barrel 42 of the bat 10 away from the batter's body and head. Arms of the batter are extended away from the batter's torso. Turning now to FIGS. 4*e-k*, the batter 62 pulls the bat 40 from the bat chamber 36*a* by sliding it out of the sleeve and along the guide 38 before following through with the batter's swing 210. The sleeve 36 and guide 38 position the bat correctly with respect to the batter's body, and limit the batter's range of motion when s/he initiates the batting swing. The batter's shoulder 64 maintains its height.

Figure 4A:
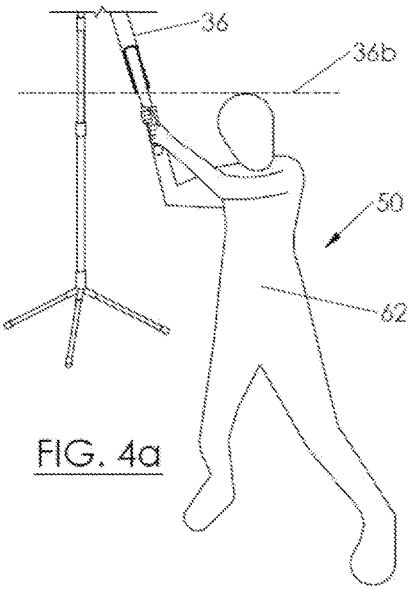
FIGS. 4*a-d* are perspective views of a batter in a batting stance next to the batting trainer of FIGS. 1-3, with a bat in a batting starting position in the trainer.
Figure 4B:
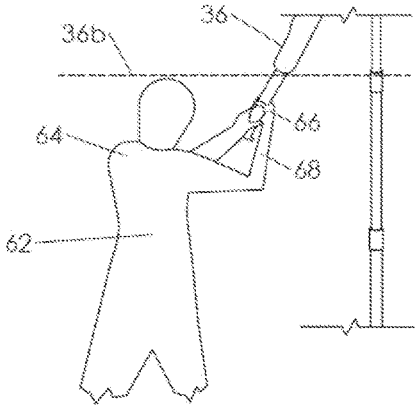
Figure 4C:
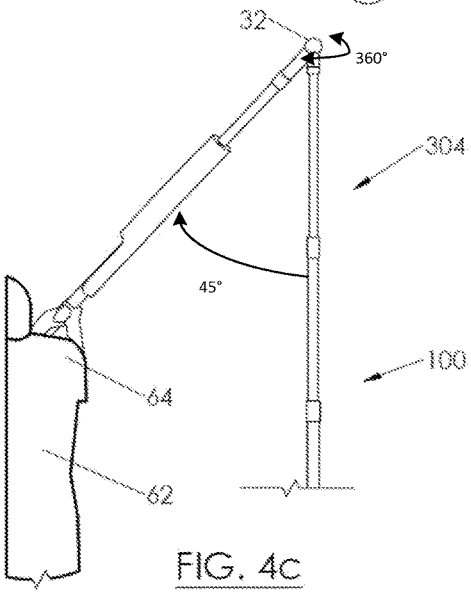
Figure 4D:
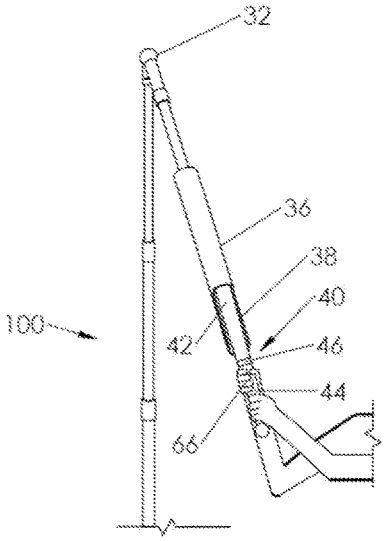
Figure 4E:
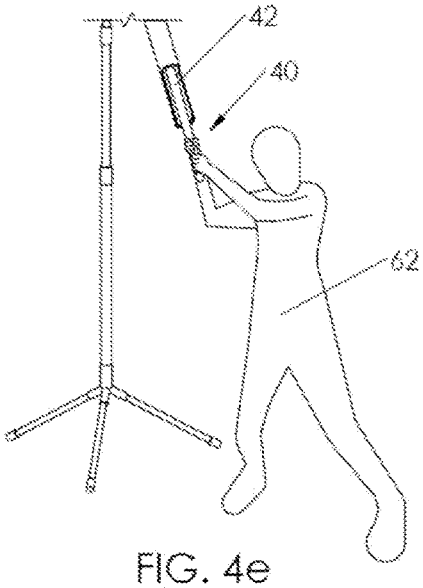
FIGS. 4*e-k* show a method of using the trainer to swing a baseball bat once the batter is in the batting starting position shown in FIGS. 4*a-d*.
Figure 4F:
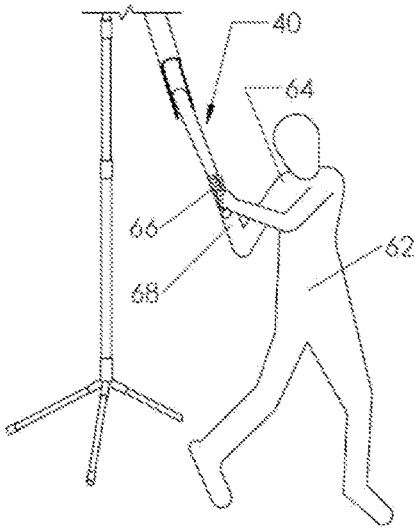
Figure 4G:
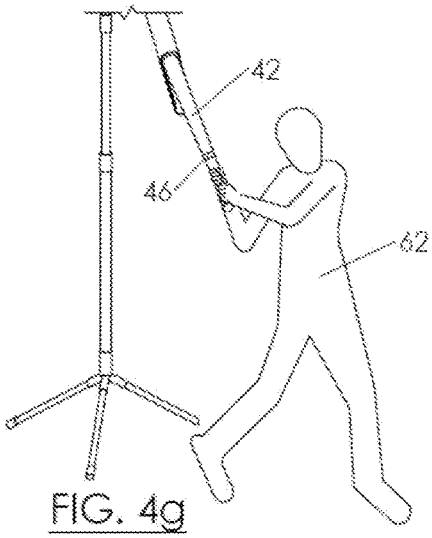
Figure 4H:
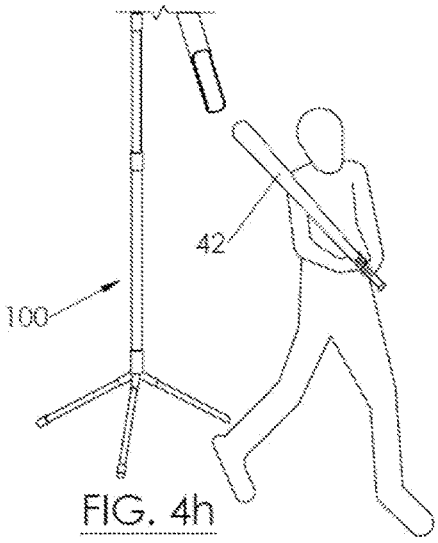
Figure 4I:
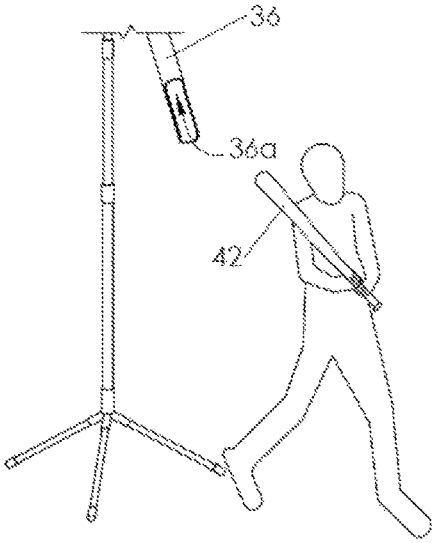
Figure 4J:
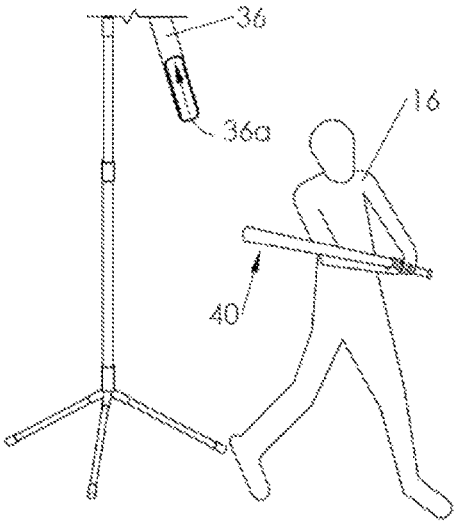
Figure 4K:
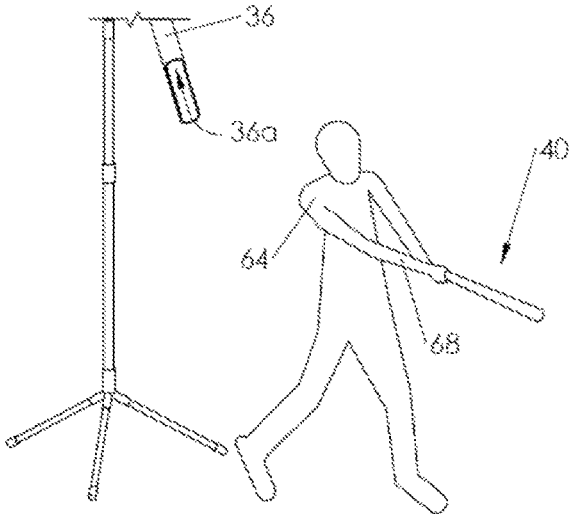
Figure 5A:
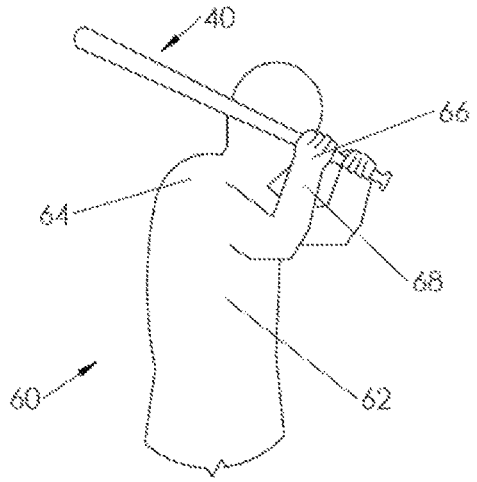
FIG. 5a PRIOR ART
FIGS. 5*a-c* are perspective views of a batter in a prior art batting stance holding a bat in a prior art batting starting position.
Figure 5B:
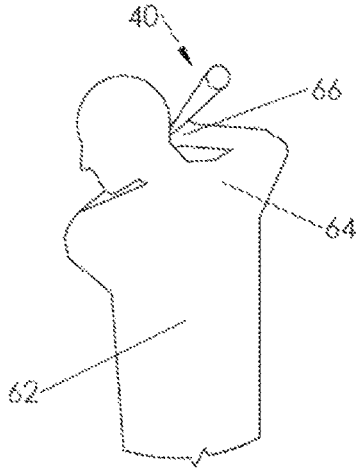
FIG. 5b PRIOR ART
Figure 5C:
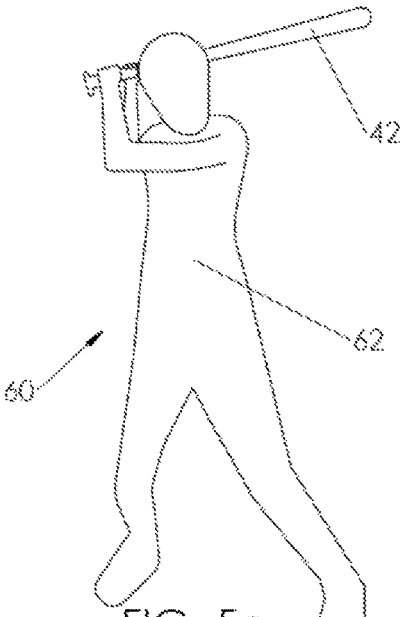
FIG. 5c PRIOR ART
Figure 5D:
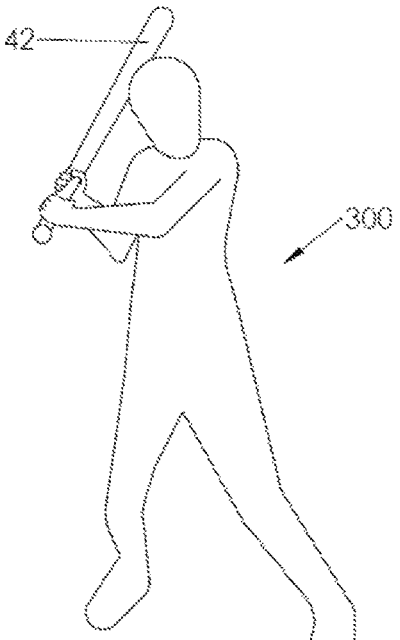
FIG. 5d PRIOR ART
FIGS. 5*d-g* are perspective views of the batter in FIGS. 5*a-c* showing a prior art method of swinging a baseball bat.
Figure 5E:
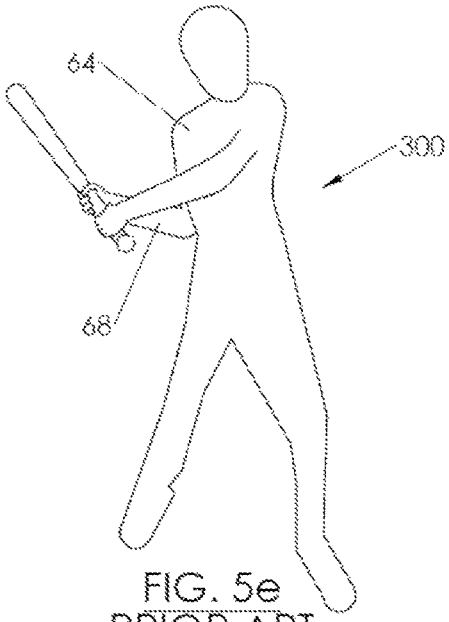
FIG. 5e PRIOR ART
Figure 5F:
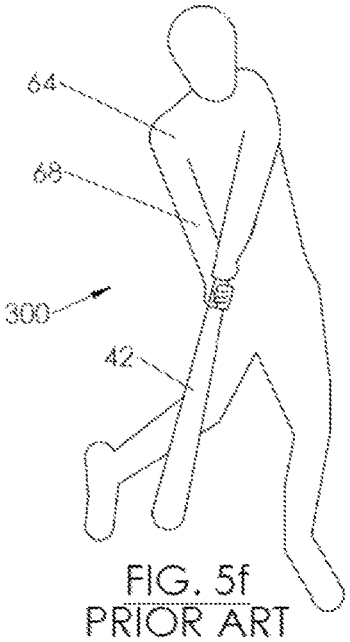
FIG. 5f PRIOR ART
Figure 5G:
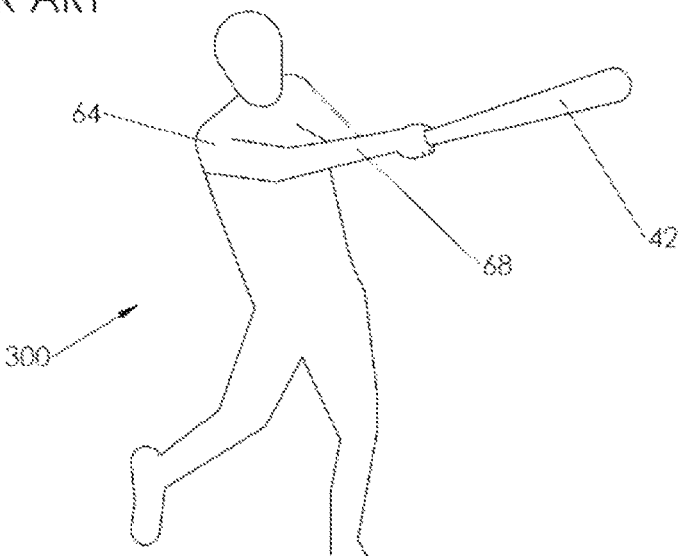
FIG. 5g PRIOR ART
Figure 6:
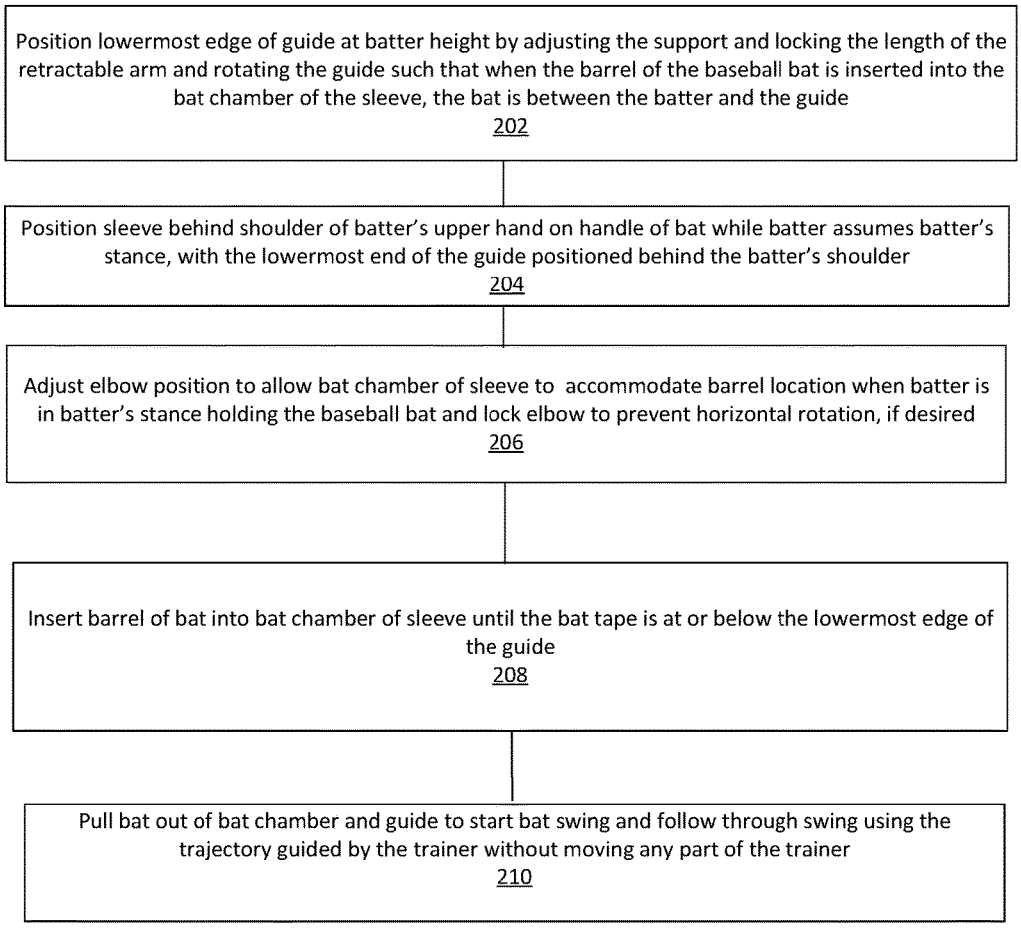
FIG. 6 is a diagrammatic illustration of the method described in FIGS. 4*a-k*.

Placement of the bat during initiation of the swing is critical as well as the start of the swing, as these both determine the trajectory of the rest of the swing follow through. Improper placement of the bat 40 during the batting stance is a common batting technique error that the trainer 100 is designed to correct and prevent. As shown in FIGS. 4*e-k*, the sleeve 36 and guide 38 force the barrel 42, as it is removed from the sleeve and guide, to maintain its original upright position for an ideal amount of time, as measured by the length of the sleeve 36 and guide 38, resulting in a swing follow through once the barrel 42 is fully released from the sleeve 36 and guide 38 that follows a trajectory roughly parallel with a forearm 68 of the batter 62 in mid swing, as shown in FIGS. 4*j-k*, which is the point of the swing where a baseball is ideally struck by the bat. The guide 38 is positioned such that the cutaway portion faces the batter 62, as in the Figures, where the inserted barrel is between the batter and the guide, however the guide 38 can be turned to face a number of different positions to correct faulty batting swings in order to lengthen or shorten the amount of time the bat is in contact with the guide 38, in order to maintain good positioning of the bat 40 during initiation of the swing. In the Figures, the guide 38 is simply a cutaway portion of the lowermost part of the sleeve, and in this embodiment, the entire sleeve-retractable arm is rotatably coupled to the elbow 32, allowing the arm (and the attached sleeve) to be turned within the elbow, allowing the guide to be adjusted accordingly. In other embodiments, when the guide itself is rotatably affixed to the lowermost portion of the sleeve, the guide is rotated as desired without adjusting the sleeve or retractable arm, and then locked by a guide lock 13*a*, as desired. Once all desired adjustments have been made to the trainer, including height of support and length of retractable arm adjusted, elbow angle adjusted, and guide position adjusted, all locks are engaged and thus when it is time to bat, when the barrel 42 is removed from the sleeve 36, no part of the trainer 100 moves, rotates, or otherwise pivots. The trainer 100 thus must be of a sufficient mass and size to promote stability and withstand the fast sliding and pulling motion of the batter quickly removing the barrel from the bat chamber 36*a*.

In contrast to the ideal batting swing produced by the method 200 of using the trainer 100, in the prior art batting method 300, shown in FIGS. 5*a-g*, the batter 62 stands in a common prior art batting stance 60, with the bat 40 wrapped around the batter's head. The batter 62 swings, dropping his shoulder 64 during his swing follow through, resulting in the bat trajectory curving downwards before going upwards, commonly known as "casting". The swing shown in the Figures is a common improper swing, as a swing curving downwards mid swing will result in missed hits and thus strikes against the batter 62. The inventor, who is a professional batting coach with over 35 years of experience training players batting technique, notes that effective batting technique is difficult to learn because the bat 40 is completely unguided and thus has a full range of possible motion, good and bad, and a player learning to bat or trying to learn effective technique must internalize and interpret verbal suggestions from coaches into physical movements, which is a difficult task. Repeatability and consistency are key for developing "mental memory" and "muscle memory", where the body learns through repetitive motion the correct positioning of all the parts, and the mechanics of a good swing. The inventor notes that the trainer 100 with the method 200 allows a player to self-practice consistent, effective technique every time, learning the feel of correct batting stance and position of the barrel with respect to his or her arms and torso, and thus training is vastly improved and time to develop the muscle memory shortened. Currently, a single coach must race from player to player to correct batting technique, but one coach with multiple trainers 100 can, by teaching his or her batters the method 200 of using the trainer 100, train his or her entire team all at the same time and know that everyone is learning and practicing consistent, repeatable batting swings.

The inventor notes that the batter 62 with a poor batting technique often is not aware of the physical problem and the trainer 100, with the elbow 32 unlocked and freely rotating in the horizontal plane, is a useful tool to show the batter 62 what he or she is doing wrong. For instance, the batter 62 shown in FIGS. 5*a-g* is wrapping the bat around his or her head and then casting during the swing, but if using the trainer 100 with the elbow freely rotating, such a starting batting position and swing follow through will move the sleeve 36 in an arc when the bat is removed from the sleeve during the bat swing follow through, as the elbow turns on the upper shaft 10*c*. A proper batting technique does not move the sleeve or any other part of the trainer at all; only the bat moves during a correct swing. By allowing the elbow to rotate freely in the horizontal plane, the batter 62 is forced to relearn his or her swing and starting position, and this provides the batter useful information to help self-correct bad technique. A locked (non-rotating) elbow immediately improves the batter's swing, but the inventor has found that allowing the elbow to rotate in the horizontal plane helps the batter correct technique mistakes far more quickly as it gives the batter a better understanding of bad technique.

The inventor's current varsity high school baseball team, consisting of 16-18 year old student athletes, has been using a prototype trainer during the inventor's testing of the design, and to date the team has a 13-1 winning season, with several student athletes significantly improving their batting averages as shown in the table below:

| Player | Batting Average Pre Trainer Use | Batting Average Post Trainer Use | Difference in Batting Average Points |
|---|---|---|---|
| 1 | .300 | .350 | 50 |
| 2 | .342 | .450 | 108 |
| 3 | .243 | .478 | 235 |
| 4 | .241 | .412 | 171 |
| 5 | .275 | .421 | 146 |
| 6* | .250 | .625 | 375 |

In the table, Player 6 used the trainer 100 more hours than Players 1-5. He has been able to perfect his swing with repetitive use of the trainer 100, which has trained his mind and body to internalize proper batting stance, bat location, and swing follow through to allow for consistent batting every time. The trainer has allowed Player 6 to consistently practice the same technique and consistently correct technique errors. Unlike the prior art method of teaching batting, every time Player 6 uses the trainer 100, the trainer teaches him consistent, repeatable technique that does not require him to mentally decipher verbal suggestions such as "keep your elbow up", or "don't drop your shoulder too much" which are hard to translate into consistent, repeatable motions.

It is to be understood that the above-described arrangements are only illustrative of the application of the principles of the present invention. Numerous modifications and alternative arrangements may be devised by those skilled in the art without departing from the scope of the present invention. For instance, the inventor believes the key component of the trainer is the telescopic receiver 30, and thus the telescoping shaft and the legs and leg set shown in the Figures is just one convenient, portable and stable way to support the telescopic receiver 30. The tripartite shaft is designed to allow the trainer 100 to be easily and conveniently stored and carried from baseball field to indoor batting cage, etc. For a more permanent setting, such as a dedicated batting cage, the telescoping shaft 10 could be easily replaced by a number of different supports emanating from the ground, walls or ceiling, such as with hinged arm supports commonly seen for affixing mirrors to bathroom walls, or overhead lighting for dental chairs, or in surgical rooms, etc. Any of these other support types can be configured so as to be horizontally rotatable. Even the ability to vary the height of the support can be eliminated if the telescoping receiver has a sufficiently long retractable arm that can be positioned and locked in place in cases where the telescoping receiver is supported from a high wall or ceiling.

The inventor is recently aware of another batting trainer, as described in U.S. Pat. No. 8,118,692 ("Day" patent) that also uses a vertical stand supporting a bat sleeve into which the batter places his or her bat and then pulls the bat out of the sleeve when swinging, the sleeve in Day purporting to guide the bat into a correct swing and thus train the batter proper batting technique. The inventor believes that the batting trainer disclosed in Day has many serious structural flaws: the sleeve itself is adjustable only vertically by pivoting the sleeve at one end via a bracket, which allows the batter to adjust the angle of the open end of the sleeve into which the bat is positioned. This allows the batter to find a comfortable stance with the bat and the trainer. At Col. 3, lines 34-41, there is a pivoting bracket that is fixedly attached to the vertical support, the pivoting bracket attached to the sleeve ("chute" in Day) that can pivot vertically from 0 to 90 degrees. Day does not disclose a horizontally rotatable bracket; his bracket only allows the sleeve to move up and down to create different entry angles for the bat ease of insertion of the bat by the batter. At Col. 4, lines 1-6, Day notes the following:

> The bracket 140 allows for the angle adjustability and can secure the chute at different angles. The adjustability is used for the same reason as the height adjustability in order to fulfill the needs of players of all sizes. The bracket can have the rotational adjustability [emphasis added] secured with a spring, a pin, or counter balance weight added to the counter balance end 155.

It is clear from Day that "the rotational adjustability" discussed is the vertical rotational adjustability of the chute moving up and down in the bracket and the securing means (pin, spring etc.) are designed to help maintain the angle of the chute (sleeve), which is different from the inventor's rotating elbow, which is rotating in a horizontal plane about the upper shaft 10*c* of the support 10, or alternatively, where the elbow is fixed to the upper shaft, the upper shaft itself rotates in a horizontal plane about the shaft in which it is coupled (either the mid or lower shaft). The inventor independently created his trainer 100 through countless hours of trial and refinement, and has found that the fixed 45 degree vertical angle of the sleeve disclosed herein and shown in the Figures is an optimal angle for correct batting technique, regardless of the height of the batter, although a range of 40 to 50 degrees can also produce acceptable results, and the 45 degree angle shown in the Figures is simply one embodiment of the trainer, and is not meant to exclude other angles in the range of 40-50 degrees. The angle is always fixed and is not adjustable, so for instance, a trainer where the sleeve angle is 42 degrees cannot be adjusted vertically and remains fixed at 42 degrees. To accommodate varying heights of different batters, the support 10 is raised or lowered, and/or the retractable arm 34 is shortened or lengthened. In Day, the vertical support height as well as the angle of the chute (sleeve) are adjustable to accommodate the batter's height. Day thus allows the batter to choose an angle for the sleeve and thus for the starting bat position, tragically allowing a batter to choose an improper starting position, such as wrapping the bat around the batter's head and without the batter's awareness that this stance is incorrect as the trainer allows such a position by the vertical adjustability of the sleeve angle. The inventor's trainer 100, however, helps correct two common problems with batting: starting bat position and swing follow through. With its fixed angle for the sleeve, preferably at 45 degrees, the trainer according to the invention 100 prevents the batter from inadvertently using an incorrect position. Further, the ability of the elbow 32 to rotate up to 360 degrees about the uppermost end of the upper shaft 10*c* gives the batter a unique ability to understand and troubleshoot his or her improper batting swing. Day's fixed bracket denies the batter valuable swing information that can be used to more quickly understand and thus resolve improper technique. While the elbow 32 can be locked in place and force the batter to always swing properly, leaving the elbow freely rotatable in the horizontal plane challenges the batter to swing properly, and even if unlocked, a proper swing will result in a stationary elbow and sleeve. The inventor himself often trains his batters first with an unlocked elbow, and then reinforces the muscle memory by training with a locked elbow.

What is claimed is:

1. A baseball trainer for use with a baseball bat having a barrel, the baseball trainer comprising;

a vertical stand having at least an upper shaft coupled to a lower shaft;

a telescopic receiver having a sleeve with a closed end and an open end, terminating in a guide at the open end, the sleeve formed with an interior bat chamber sized and shaped to receive the barrel, the interior chamber accessible by a single opening at the guide and sleeve interface; and an elbow having a receiver end and a support end, the receiver end of the elbow affixed to the telescopic receiver, and the support end affixed to the upper shaft of the vertical stand;

wherein the elbow holds the telescopic receiver at a fixed angle below a horizontal plane as measured from an uppermost portion of the elbow, the fixed angle being at least 40 degrees and no more than 50 degrees;

wherein the guide is further comprised of a channel upon which a side of the bat is cradled, but with a side of the bat opposed to the channel unsupported by the guide; and wherein at least one of the elbow and the upper shaft of the vertical stand is rotatable by a maximum of 360 degrees relative to the lower shaft of the vertical stand.

2. The trainer of claim 1, wherein a diameter of the interior chamber is no greater than three inches.

3. The trainer of claim 1, wherein the telescopic receiver further comprises a retractable arm having a first end slideably and rotatably coupled to the receiver end of the elbow, and having a second end fixedly coupled to the closed end of the sleeve, and wherein the retractable arm slides in and out of the elbow and rotates within the elbow.

4. The trainer of claim 3, wherein the retractable arm is further comprised of a length and the elbow is further comprised of an arm lock coupled to the receiver end;

wherein the length can be fixed in place by locking the arm lock and the length can be adjusted by unlocking the arm lock.

5. The trainer of claim 1, wherein the guide and the sleeve are separate units rotatably coupled together, and wherein a position of the guide is rotatably adjusted.

6. The trainer of claim 5, wherein the guide is at least 5 inches long.

7. The trainer of claim 5, wherein the guide is no more than 7 inches long.

8. The trainer of claim 5, wherein the guide is about 6 inches long.

9. The trainer of claim 1, wherein the guide and sleeve are a single unit.

10. The trainer of claim 1, further comprising a stand having at least one leg, the stand affixed to the lower shaft of the vertical support.

11. The trainer of claim 1, wherein the fixed angle is 45 degrees.

12. The trainer of claim 1, further comprising an elbow lock, wherein the elbow is rotationally coupled to the upper shaft, and the elbow is fixed to the upper shaft by locking the elbow lock, and allowed to rotate freely on the upper shaft by unlocking the elbow lock.

13. A method of teaching a batter to swing a bat using a trainer comprising a sleeve with a barrel receiving bat chamber, an adjustable position guide affixed at an open end of the sleeve, a stand, and an adjustable elbow joining the stand and the sleeve, the batter using a baseball having a barrel, a handle, and a tape at an intersection of the barrel and the handle, the method comprising the steps of:

Positioning a lowermost edge of the guide approximately at a height of the batter and rotating the guide so that when a baseball bat is inserted into the bat chamber of the sleeve, the baseball bat is between the batter and the guide;

Adjusting the elbow so as to allow the bat chamber to accommodate the barrel location when the batter is in batter's stance holding the baseball bat and locking the elbow in position if desired;

Inserting the barrel into the bat chamber until the tape is at or below the lowermost edge of the guide; and Pulling the barrel out of the bat chamber and guide to commence bat swing and follow through swing using a trajectory guided by the trainer without moving any part of the trainer.

14. The method of claim 13, using the trainer of claim 1.

* * * * *